United States Patent [19]

Sachleben, Sr. et al.

[11] 4,327,872

[45] May 4, 1982

[54] YARN END RETAINER

[75] Inventors: Harold G. Sachleben, Sr., Bellmawr, N.J.; Robert Lees, Chester, Va.

[73] Assignee: Allied Corporation, Morris Township, Morris County, N.J.

[21] Appl. No.: 127,166

[22] Filed: Mar. 4, 1980

[51] Int. Cl.[3] ..... B65H 54/02; B65H 67/04

[52] U.S. Cl. ..... 242/18 A

[58] Field of Search ..... 242/18 A, 18 R, 18 DD, 242/18 PW, 35.5 R, 35.5 A, 157 R, 157.1, 20, 24

[56] References Cited

U.S. PATENT DOCUMENTS

| | | | |
|---|---|---|---|
| 391,905 | 10/1888 | Lewis | 242/24 X |
| 2,171,758 | 9/1939 | McKean | 242/18 R |
| 2,489,134 | 11/1949 | Hill | 242/18 R |
| 3,086,720 | 4/1963 | Leach | 242/20 |
| 3,165,274 | 1/1965 | De Priest | 242/18 A |
| 3,409,238 | 11/1968 | Campbell et al. | 242/18 A |

FOREIGN PATENT DOCUMENTS

| | | | |
|---|---|---|---|
| 239809 | 7/1962 | Australia | 242/157.1 |

*Primary Examiner*—Stanley N. Gilreath
*Attorney, Agent, or Firm*—Virginia S. Andrews

[57] ABSTRACT

A yarn end retainer is disclosed for use in conjunction with a wound yarn package. The yarn end retainer comprises a bail, pivot means and means for urging the bail to pivot about the pivot means in a first direction. The bail comprises at least one leg terminating in an end portion, the leg being mounted for pivotal movement about the pivot means. When the bail is urged to pivot in the first direction, the end portion rides a part of the surface of the yarn package when the yarn package doffs.

7 Claims, 9 Drawing Figures

YARN END RETAINER

BACKGROUND OF THE INVENTION

1. Field of the Invention

The present invention relates to apparatus for retaining a loose yarn end on a rotating yarn package. More particularly, the present invention relates to a yarn end retainer for use in conjunction with a fully wound yarn package after doffing by an automatic doff winder.

2. Description of the Prior Art

Winding devices having an automatic yarn transfer system are known. See, for example, U.S. Pat. No. 3,856,222 to Wust, U.S. Pat. No. 3,920,193 to Gujer et al., U.S. Pat. No. 3,921,922 to Wust, U.S. Pat. No. 3,941,321 to Bosshard et al., and U.S. Pat. No. 4,019,690 to Gujer Peter et al. In essence, these devices include a drive roll and at least two rotatable bobbin chucks commonly seated on a rotatably supported bobbin arm. The bobbin chucks each receive a tube on which the yarn is wound when the tubes are alternately pivoted into driving contact with the drive roll. When the surface driven yarn package has increased to doff size, the yarn package is doffed, i.e., pivoted out of contact with the drive roll to a stationary position, the winding yarn end being severed and the other tube pivoted into driving contact with the drive roll. The doffed yarn package continues to rotate for a while due to inertia; the free trailing yarn end can become tangled with the drive roll, with the tail of and/or the new yarn package being wound, and/or other nearby equipment. Naturally ths snarl would undesirably interrupt winding.

The entanglement or snarling of trailing yarn ends between a drive roll and full yarn packages has heretofore been prevented by shields, as disclosed in U.S. Pat. No. 3,165,274 to DePriest and U.S. Pat. No. 3,409,238 to Campbell et al.

SUMMARY OF THE INVENTION

The present invention provides a yarn end retainer, for use in conjunction with a wound yarn package. The yarn end retainer comprises a bail, which in turn comprises at least one leg terminating in a package end portion. The leg is mounted for pivotal movement about pivot means, and means is provided for urging the bail to pivot in a first direction such that the package end portion rides a part of the surface of the yarn package when the yarn package doffs.

In a preferred embodiment the yarn end retainer comprises as its major elements a pivot pin, means for mounting the pivot pin, a bail, a loop, a first spring, a first stop, and means for overriding the function of the first stop. The bail comprises two legs terminating in a package end portion, each of the legs being mounted at its opposite end for pivotal movement about the pivot pin. The package end portion rides a part of the surface of the yarn package when the yarn package doffs. The loop is formed at the package end portion. The first spring urges the bail to pivot in a first direction. The first stop inhibits movement of the bail in the first direction when the bail is urged into contact therewith. It is even more preferred that the first stop be a pivoted first stop, the legs of which are mounted for pivotal movement about the pivot pin, and the base of which inhibits movement of the bail in the first direction when the bail is urged into contact with the base. It is also preferred that the means for overriding the function of the first stop comprises a second spring and a second stop. The second spring connects the pivoted first stop and the mounting means, and urges the pivoted first stop in a direction opposite the first direction. The second stop, preferably rigid, is positioned so as to inhibit movement of the pivoted first stop in the direction opposite the first direction when the pivoted first stop is urged into contact with the second stop. It is preferred that one of the legs be bent intermediate to the package end portion and its opposite end to form a ramp surface, and further that a shield be provided to prevent the yarn from snarling or becoming entangled in any of the pivot points or springs.

In an alternate but equally preferred embodiment, the yarn end retainer comprises as its major elements a rod and a pivot axes mounting bracket. The rod is bent into a substantially "U"-shape, the package end portion of the "U"-shaped rod describing a loop and riding a part of the surface of the yarn package when the yarn package doffs. Each of the legs of the "U"-shaped rod is bent to terminate in a pivot axis, the pivot axes being parallel to one another and at an angle of about zero to twelve degrees, more preferably seven degrees, with respect to the package end portion. One of the legs is bent intermediate to its package end portion and pivot axis to form a ramp surface.

The invention will be more clearly understood and additional objects and advantages will become apparent upon reference to the discussion below and to the drawings which are given for illustrative purposes.

DETAILED DESCRIPTION OF THE DRAWINGS

Figure 1:
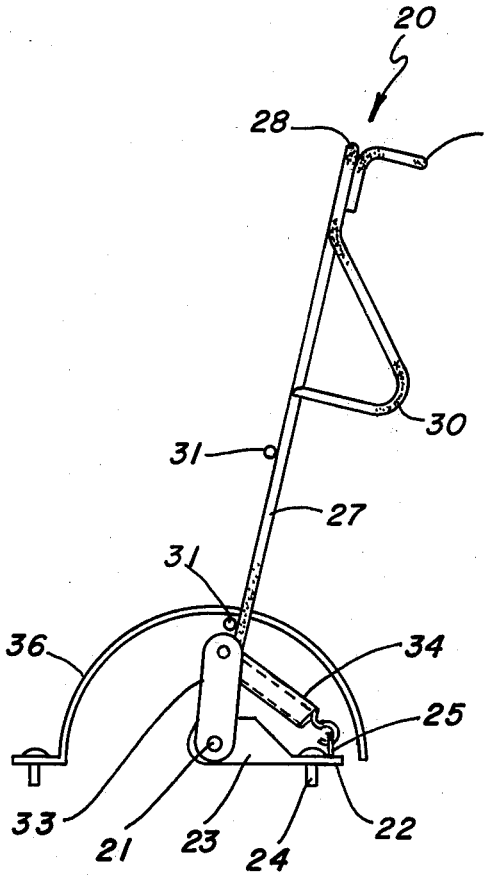
FIG. 1 is a side view of a yarn tail retainer of the present invention with a shield.

In the accompanying drawings, like numbers refer to like apparatus. It is to be understood that only enough of the winding device has been shown in the drawings to enable those skilled in the art to understand and appreciate the underlying concept of the yarn tail retainer comprising the present invention. For more detail on the winding device, reference may be had to U.S. Pat. No. 3,856,222 to Wust, U.S. Pat. No. 3,920,193 to Gujer et al., U.S. Pat. No. 3,921,922 to Wust, U.S. Pat. No. 3,941,321 to Bosshard et al., and U.S. Pat. No. 4,019,690 to Gujer Peter et al., hereby incorporated by reference.

Briefly and with reference to FIGS. 3A, 3B, 3C and 4, the winding device includes a rotatably supported bobbin arm 10 which can be rotated in a counterclockwise direction. Rotatable bobbin chucks 11 and 11' are commonly seated on bobbin arm 10 and receive, respectively, tubes 12 and 12'. A friction drive roll 13 alternately drives the bobbin chucks 11 and 11' while a thread or yarn 14 is traversed by a traversing thread guide (not shown) to wind a package. When doffing a package, the thread or yarn 14 is cut and transferred onto a given one of the tubes 12 or 12' (which is shown in and out of the winding position) for the purpose of winding and building up the subsequent yarn package in the traversing manner well known in the art.

Figure 2:
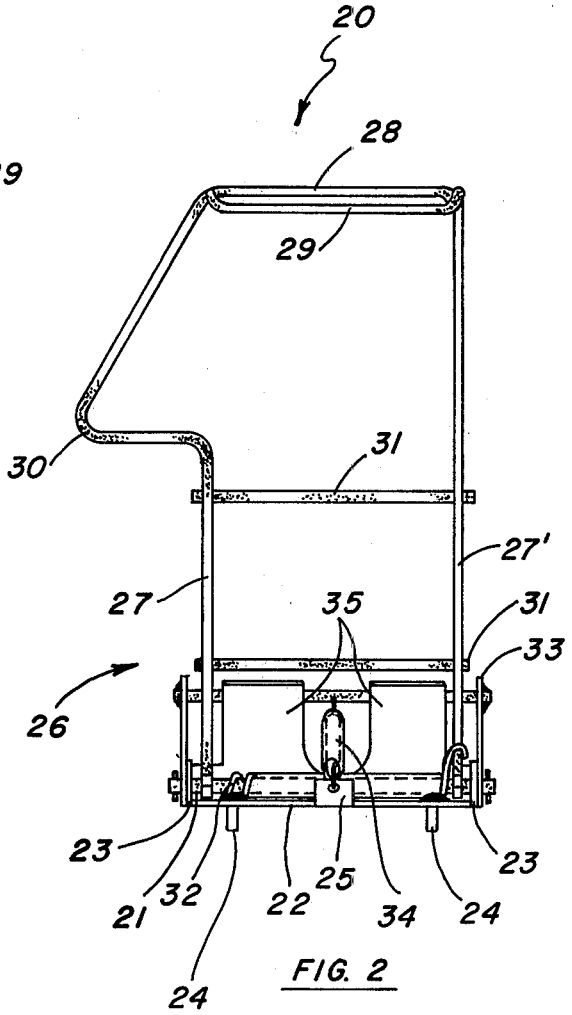
FIG. 2 is a front view of the yarn tail retainer of FIG. 1 with the shield omitted.

A preferred embodiment of the yarn tail retainer 20 of the present invention is shown in FIGS. 1 and 2. Yarn end retainer 20 comprises as its major elements a pivot pin 21, means for mounting pivot pin 21, a bail 26, a loop 29, a first spring 32, a pivoted first stop 33, a second spring 34, and a rigid second stop 35. The means for mounting pivot pin 21 is not critical and can be, as depicted in FIGS. 1 and 2, an angled bracket 22 having a pair of ears 23 with apertures therethrough axially aligned with one another and through which pivot pin 21 passes. Angled bracket 22 is affixed to the structure therebelow, e.g., the floor, by bolts 24 associated with slots (unshown) in the base of bracket 22. Tab 25, the function of which will be explained below, rises from the base of bracket 22. Bail 26 comprises two legs 27 and 27' terminating in a connecting package end portion 28. Each of legs 27 and 27' is mounted at its opposite end for pivotal movement about pivot pin 21 between ears 23 of bracket 22. As best shown in FIG. 3B, package end portion 28 rides a part of the surface of the yarn package when the yarn package doffs. Loop 29 is formed at package end portion 28 and in this embodiment, forms with package end portion 28 a curved rectangle at the package end of bail 26 and substantially perpendicular thereto. Bars 31 connecting legs 27 and 27' of bail 26 are for reinforcement purposes only. First spring 32, depicted in FIG. 2 as a right-hand wound torsion spring, wraps around pivot pin 21 between legs 27 and 27' of bail 26 and is connected at one end to leg 27'. First spring 32 urges bail 26 to pivot about pivot pin 21 in a first direction, e.g., to the left and away from the base of bracket 22 as shown in FIGS. 1, 3A, 3B and 3C. The legs of the pivoted first stop 33 are mounted for pivotal movement about pivot pin 21 with ears 23 separating them from legs 27 and 27' respectively of bail 26. The base or rod portion of pivoted first stop 33 inhibits movement of bail 26 in the first direction, e.g., to the left and away from the base of bracket 22 in FIG. 1, when legs 27 and 27' of bail 26 are urged by first spring 32 in conact with the base of bracket 22. The second spring 34 is an extensible spring which connects pivoted first stop 33 at the center of its base or rod portion with tab 25 of angled bracket 22. Second spring 34 urges pivoted first stop 33 in a direction opposite to that in which bail 26 is urged, i.e., to the right and toward the base of bracket 22 in FIG. 1. The pull of second spring 34 on pivoted first stop 33 is greater than and overrides the pull of first spring 32 on bail 26. A rigid second stop 35 (see FIG. 2) is positioned so as to inhibit movement of pivoted first stop 33 in a direction opposite the first direction, i.e., to the right and toward the base of bracket 22 in FIG. 1, when pivoted first stop 33 is urged into contact with rigid second stop 35. In FIG. 2, rigid second stop 35 is depicted as the top of the back of angled bracket 22. A portion of the back of angled bracket 22 is cut away to permit the attachment of second spring 34 to pivoted first stop 33. Leg 27 is bent intermediate to its package end portion 28 and opposite end to form a ramp surface 30, the function of which will be explained below. It is preferred that a shield 36, as shown in FIG. 1, be provided to prevent yarn from snarling or becoming entangled in any of the pivot points, springs or other moving elements. Shield 36 is a curved surface which extends up and over the lower reinforcing bar 31 between legs 27 and 27' of bail 26.

Figure 3A:
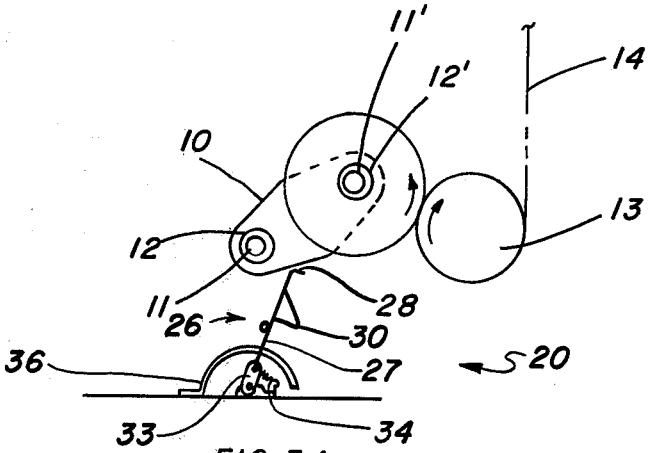
FIG. 3A is a schematic side view of the yarn tail retainer of FIGS. 1 and 2 mounted below the rotatably supported bobbin arm carrying an empty spool/tube and a yarn package which has increased to doff size, the yarn tail retainer being in its inoperative position, i.e., contacting no mechanism or package.
Figure 3B:
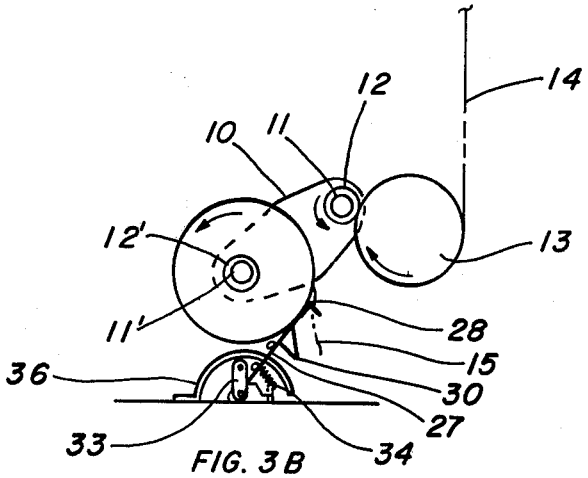
FIG. 3B is a schematic side view similar to FIG. 3A but showing the yarn tail retainer in its operative position, i.e., riding a part of the surface of the doffed yarn package and trapping the cut tail of the yarn package.
Figure 3C:
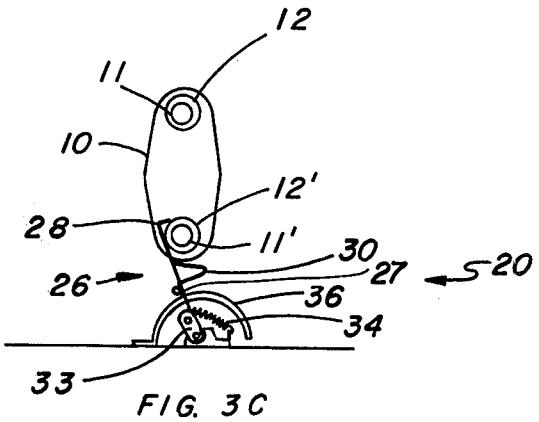
FIG. 3C is a schematic side view similar to FIGS. 3A and 3B but showing the yarn tail retainer being deflected without damage by a traverse rejected spool/-tube mechanism.

In FIG. 3A, yarn tail retainer 20 of FIGS. 1 and 2 is mounted below rotatably supported bobbin arm 10 which carries an empty tube 12 at one end and a yarn package which has increased to doff size at its other end about tube 12'; yarn tail retainer 20 is in its normal, inoperative position, i.e., contacting no mechanism or package.

In FIG. 3B, the yarn package has doffed and its tail has been severed; bobbin arm 10 has rotated in a counterclockwise direction, and a new package has begun winding on tube 12. Rotation of bobbin arm 10 brings the full package into contact with bail 26, which pivots to the right (FIG. 3B) due to deflection by the package; the doffed position of the package is such that bail 26 should not be forced completely horizontal. First spring 32 urges bail 26 against the doffed package so that package end portion 28 rides against its surface to retain yarn end 15 thereagainst. The function of loop 29 is to trap yarn end 15 when there is any reverse rotation of the yarn package at the end of package braking. Yarn tail retainer 20 is now in its operative position. When the operator removes the doffed package for replacement with an empty tube 12, first spring 32 urges bail 26 to pivot into contact with pivoted first stop 33 which halts further movement thereof; yarn tail retainer 20 is now in its normal, inoperative position again.

In the event a full or partially wound yarn package is installed on an empty bobbin chuck, the initial end of the package as it is being slid on the chuck will encounter ramp surface 30 and cause bail 26 of retainer 20 to deflect to a suitable extent for completion of the installation without breaking yarn end retainer 20. An angle of about 45° between ramp surface 30 and the plane of legs 27 and 27' is preferred although an angle of from about 30° to 50° would be suitable.

In the event bobbin arm 10 reverses (to the left in FIG. 3C) because of, for example, being traverse rejected, yarn tail retainer 20 will be deflected without damage. Bobbin chuck 11' with tube 12' will contact bail 26 and urge it against pivoted first stop 33 with a force which overrides the pull of second spring 34 in the opposite direction. When bobbin arm 10 is returned to normal operation, the overriding force of bobbin chuck 11' is removed and second spring 34 once again pulls pivoted first stop 33 back into its normal position, i.e., resting against rigid second stop 35.

The materials of construction for this embodiment are preferably as follows: for the springs, a coiled music wire, and for the other elements a metal preferably stainless steel.

Figure 4:
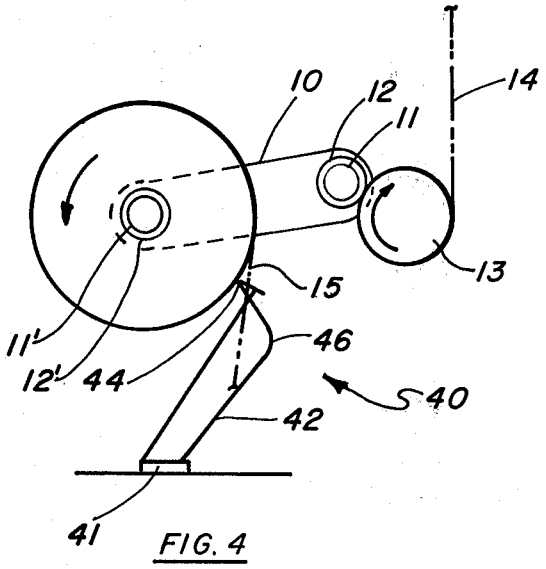
FIG. 4 is a schematic side view of the yarn tail retainer of FIGS. 5–7 showing the yarn tail retainer in its operative position, i.e., riding a part of the surface of the doffed yarn package and trapping the cut tail of the yarn package.
Figure 5:
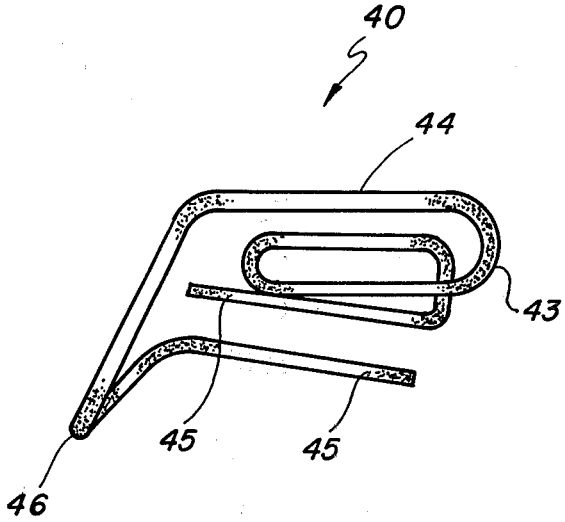
FIG. 5 is a plan view of the yarn tail retainer of FIG. 7.
Figure 6:
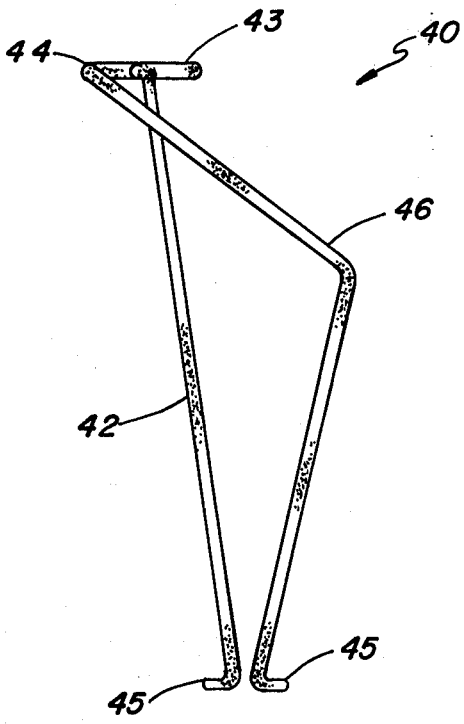
FIG. 6 is a side view of the yarn tail retainer of FIG. 7.
Figure 7:
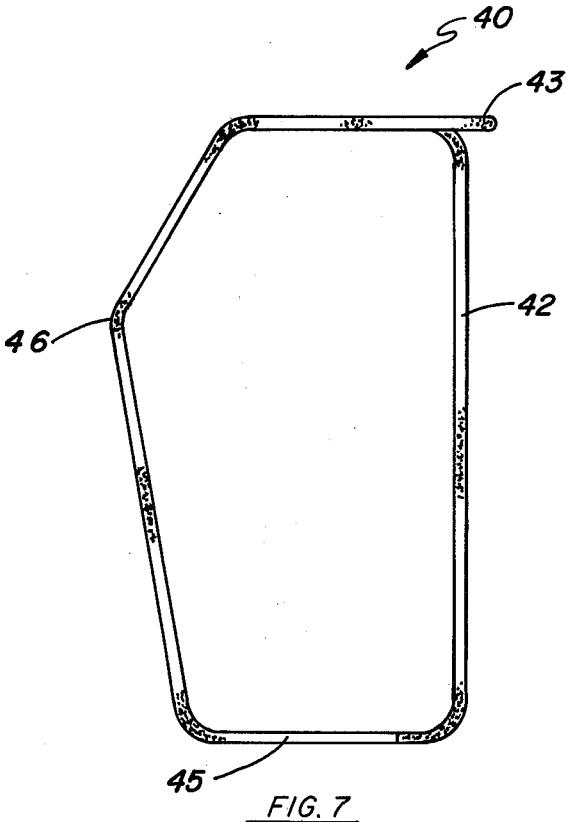
FIG. 7 is a front view of an alternative embodiment of the yarn tail retainer of the present invention.

An alternate but equally preferred yarn end retainer 40 is shown in FIGS. 4, 5, 6 and 7. Yarn end retainer 40 comprises as its major elements a pivot axes mounting bracket 41 and a rod 42. Rod 42 is bent into a substantially "U" shape, the package end portion of the rod describing a loop 43 and having a surface 44 which rides a part of the surface of the yarn package when the yarn package doffs. Each of the legs of "U"-shaped rod 42 is bent to terminate in a pivot axis 45. With reference to FIG. 5, pivot axes 45 are parallel to one another and at an angle of about zero to twelve degrees, more preferably seven degrees, with respect to surface 44 of the package end portion. One of the legs is bent intermediate to the package end portion and its pivot axis 45 to form a ramp surface 46. Mounting bracket 41 (FIG. 4) maintains the separation of pivot axes 45 as shown in FIG. 5. Bracket 41 preferably comprises a base and two parallel, open-ended pieces of tubing attached thereto, the tubing being sufficiently large and spaced apart so that pivot axes 45 can be inserted into the pieces of tubing. Bracket 41 is preferably attached to the floor beneath rotatably supported bobbin arm 10, and pivot axes 45 of rod 42 are attached thereto. Yarn end retainer 40 is normally in the vertical, inoperative position of FIG. 6.

With reference to FIG. 4, the doffed package is shown in contact with yarn end retainer 40; the package is turning counterclockwise, and the loose yarn end 15 on the completed package is held against the package by surface 44 of the end portion of rod 42. The package has deflected the top of rod 42 to the right providing a spring force holding surface 44 of the package end portion against the package. Loop 43 at the top of yarn end retainer 40 tends to catch or trap loose yarn end 15 when there is any reverse rotation of the package at the end of package braking. Ramp surface 46 has the same purpose as and functions similarly to ramp surface 30 of the previous embodiment. The separation of the pivot axes 45 causes bending in the upper portion of rod 42 when deflected by the yarn package. This bending provides spring force which holds surface 44 of the package end portion of rod 42 against the yarn package. The tilt of the retainer pivot axes 45 with respect to surface 44 of the package end portion allows for the bending of the legs of "U"-shaped rod 42 and keeps surface 44 of the package end portion and the main axis of loop 43 parallel to the center line of the doffed yarn package. As with yarn end retainer 20, yarn end retainer 40 is sufficiently flexible to be deflected in the event bobbin arm 10 has been traverse rejected.

Rod 42 of yarn end retainer 40 preferably comprises a smooth wire, more preferably steel, that does not damage, nor is damaged by the yarn. Yarn end retainer 40 has the advantage of a minimum of parts.

In this disclosure, there are shown and described only the preferred embodiments of the invention, but it is to be understood that the invention is capable of other and different embodiments and its several details are capable of various obvious modifications, all without departing from the inventive spirit thereof. For instance, first stop 33 of the first described embodiment could slide rather than pivot in and out of its operative position; the mechanism causing the stop to slide would functionally replace second spring 34 and second stop 35. Similarly, second stop 35 need not be rigid as it could slide or pivot for operation. It is intended that this invention be limited only as set forth in the following claims.

What is claimed is:

1. A yarn end retainer, for use in conjunction with a yarn package on a yarn winding device which comprises means for moving a yarn package from a winding position to a doffed position, the yarn package having a free trailing yarn end when moved from the winding position to the doffed position, said yarn end retainer comprising:

a bail, comprising at least one leg which has two ends, one end being pivotally mounted for movement about pivot means;

and means for urging the bail to pivot in a first direction such that the other end of the leg rides a part of the surface of the yarn package to engage and retain the free trailing yarn end and prevent entanglement thereof with the winding device when the yarn package has moved to the doffed position.

2. A yarn end retainer, for use in conjunction with a yarn package on a yarn winding device which comprises means for moving a yarn package from a winding position to a doffed position, the yarn package having a free trailing yarn end when moved from the winding position to the doffed position, said yarn end retainer comprising:

a. a pivot axes mounting bracket; and b. a rod, bent into a "U" shape, each of the legs of which terminate at one end in a loop and at its other end in a pivot axis, said loop riding a part of the surface of the yarn package to engage and retain the free trailing yarn end and prevent entanglement thereof with the winding device when the yarn package has moved to the doffed position, the pivot axes being parallel to one another and at an angle of about zero to twelve degrees with respect to the loop, one of the legs being bent intermediate to the loop and the pivot axis to form a ramp surface.

3. The yarn end retainer of claim 2 wherein the pivot axes are at an angle of about seven degrees with respect to the loop.

4. A yarn end retainer, for use in conjunction with a yarn package on a yarn winding device which comprises means for moving a yarn package from a winding position to a doffed position, the yarn package having a free trailing yarn end when moved from the winding position to the doffed position, said yarn end retainer comprising:

a. a pivot pin;

b. means for mounting said pivot pin;

c. a bail comprising two legs terminating in a portion which rides a part of the surface of the yarn package to engage and retain the free trailing yarn end and prevent entanglement thereof with the winding device when the yarn package has moved to the doffed position, said legs each being mounted at its opposite end for pivotal movement about said pivot pin;

d. a loop formed near said portion;

e. a first spring, urging said bail to pivot in a first direction;

f. a first stop, which inhibits movement of said bail in said first direction when said bail is urged into contact therewith; and g. means to permit overriding the function of the first stop.

5. The yarn end retainer of claim 4 wherein one of said legs of said bail is bent intermediate to said portion and said opposite end.

6. The yarn end retainer of claim 4 wherein said first stop comprises a plurality of legs terminating in a base, the legs of said first stop being mounted for pivotal movement about said pivot pin, the base of said first stop inhibiting movement of said bail in said first direction when said bail is urged into contact with said base, and wherein said means to permit overriding the function of said first stop comprises a second spring and a second stop, said second spring connecting said first stop and said mounting means and urging said first stop in a direction opposite said first direction, said second stop being positioned so as to inhibit movement of said first stop in said opposite direction when said first stop is urged into contact with said second stop.

7. The yarn end retainer of claim 6 wherein said second stop is rigid.

* * * * *